US006349686B1

(12) United States Patent
Feucht et al.

(10) Patent No.: US 6,349,686 B1
(45) Date of Patent: Feb. 26, 2002

(54) HYDRAULICALLY-DRIVEN VALVE AND HYDRAULIC SYSTEM USING SAME

(75) Inventors: Dennis D. Feucht, Morton; David E. Hackett, Washington, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/652,172

(22) Filed: Aug. 31, 2000

(51) Int. Cl.[7] ..... F01L 9/02

(52) U.S. Cl. ..... 123/90.12; 123/90.13; 123/446; 251/30.05

(58) Field of Search ..... 123/90.12, 90.13, 123/90.11, 90.24, 90.55, 446; 251/30.01, 30.02, 30.05

(56) References Cited

U.S. PATENT DOCUMENTS

| | | | | |
|---|---|---|---|---|
| 4,466,390 A | | 8/1984 | Babitzka et al. | |
| 4,862,844 A | * | 9/1989 | Wakeman et al. | 123/90.12 |
| 4,974,495 A | | 12/1990 | Richeson, Jr. | |
| 5,003,937 A | | 4/1991 | Matsumoto et al. | |
| 5,022,358 A | | 6/1991 | Richeson | |
| 5,255,641 A | | 10/1993 | Schechter | |
| 5,339,777 A | * | 8/1994 | Cannon | 123/90.12 |
| 5,353,755 A | | 10/1994 | Matsuo et al. | |
| 5,456,221 A | | 10/1995 | Schechter | |
| 5,497,736 A | | 3/1996 | Miller et al. | |
| 5,507,316 A | | 4/1996 | Meyer | |
| 5,509,383 A | | 4/1996 | Kahrs et al. | |
| RE35,303 E | * | 7/1996 | Miller et al. | 123/90.11 |
| 5,531,192 A | | 7/1996 | Feucht et al. | |
| 5,595,148 A | | 1/1997 | Letsche et al. | |
| 5,666,915 A | | 9/1997 | Kawashima et al. | |
| 5,687,693 A | | 11/1997 | Chen et al. | |
| 5,694,893 A | * | 12/1997 | Chan et al. | 123/90.12 |
| 5,713,520 A | | 2/1998 | Glassey et al. | |
| 5,732,678 A | * | 3/1998 | Lindquist et al. | 123/446 |
| 5,829,397 A | * | 11/1998 | Vorih et al. | 123/90.12 |
| 5,960,753 A | * | 10/1999 | Sturman | 123/90.12 |
| 5,979,415 A | | 11/1999 | Sparks et al. | |
| 6,085,705 A | * | 7/2000 | Vorih | 123/90.12 |
| 6,257,183 B1 | * | 7/2001 | Vorih et al. | 123/90.12 |
| 6,263,842 B1 | * | 7/2001 | De Ojeda et al. | 123/90.12 |

* cited by examiner

*Primary Examiner*—Teresa Walberg
*Assistant Examiner*—Fadi H. Dahbour
(74) *Attorney, Agent, or Firm*—Liell & McNeil

(57) ABSTRACT

In a hydraulically actuated gas exchange valve, the initiation and termination of gas exchange is achieved with a hydraulically driven valve that functions by opening an actuation fluid passage to a high pressure inlet source and a low pressure drain, respectively. The large amount of fluid needed to actuate a gas exchange valve can result in dynamic flow forces around the hydraulically driven valve making closing of the valve with a conventional biasing spring problematic. The small size of the valve limits the size and therefore strength of the biasing springs. Likewise, the need to provide a sufficiently strong spring limits valve designs. The present invention is intended to provide superior control over the timing of gas exchange by employing a hydraulic bias in place of the conventional biasing spring. Hydraulic bias allows both a greater closing force on the valve than could be provided with a spring, and allows for greater versatility in future valve designs.

20 Claims, 2 Drawing Sheets

HYDRAULICALLY-DRIVEN VALVE AND HYDRAULIC SYSTEM USING SAME

TECHNICAL FIELD

The present invention relates generally to hydraulically driven valves and, more particularly, to hydraulic systems that use hydraulically driven valves.

BACKGROUND ART

In one class of hydraulically actuated electronically controlled fuel injectors (HEUI) such as those manufactured by Caterpillar Inc., of Peoria, Ill., a valve design is employed which precisely controls the timing and duration of fuel injection. In one version disclosed in U.S. Pat. No. 5,687,693 issued to Chen et al on Nov. 18, 1997, control of actuation fluid flow for fuel injection is achieved with a spool valve having opposing hydraulic surfaces. Although the spool valve has opposing hydraulic surfaces, it still relies upon a biasing spring to return the spool to its rest position when termination of injection is desired. While these spring biased spool valves have performed well in fuel injectors, differing demands in other hydraulic applications can render spring biasing a less than satisfactory alternative. One such example might be in control valves for gas exchange or exhaust brake actuators.

In some hydraulically actuated gas exchange valves a relatively large quantity of hydraulic fluid may be necessary to actuate the valves. In addition, this fluid must be evacuated back through the valve between events in order to reset the hydraulic devices. As a result, a significant amount of fluid must pass through the flow control valve. Where a spool valve is used, this fluid flow may create dynamic flow forces on the various surface features of the spool. In some cases, these forces necessitate a substantially greater force to return the spool to its rest position than would otherwise be necessary. Providing the necessary biasing force to completely move the spool to its rest position with a conventional biasing spring can be problematic, especially when space is limited. Furthermore, the necessity of providing space for a biasing spring can limit other aspects of valve design.

The present invention is directed to overcoming one or more of the problems set forth above.

DISCLOSURE OF THE INVENTION

In one aspect of the present invention, a hydraulically driven valve includes a valve body defining a first passage and a second passage. A valve member is positioned in the valve body and is movable between a first position in which the first passage is open to the second passage, and a second position in which the first passage is closed to the second passage. The valve member has a biasing hydraulic surface and a control hydraulic surface. A biasing pressure chamber is defined at least in part by the valve body and the valve member's biasing hydraulic surface. Also located within the valve body is a control hydraulic chamber defined at least in part by the valve body and the valve member's control hydraulic surface. The biasing pressure chamber and the control pressure chamber are fluidly isolated from the first passage and the second passage. A medium pressure force acts on the biasing hydraulic surface whereas either a high pressure or a low pressure force acts on the control hydraulic surface.

In another aspect of the present invention, a method of operating a valve includes the steps of providing a hydraulically driven valve that includes a valve body defining a first passage and a second passage. A valve member is positioned in the valve body and includes a biasing hydraulic surface and a control hydraulic surface. The biasing hydraulic surface and the control hydraulic surface are fluidly isolated from the first passage and the second passage. The valve member is then hydraulically driven toward a first position that opens the first passage to the second passage, or toward a second position that closes the first passage to the second passage.

In still another aspect of the present invention, a hydraulic system includes a source of high pressure fluid, a source of low pressure fluid, and at least one hydraulic device. Also provided is a hydraulically driven valve that includes a valve body that defines a first passage and a second passage. The hydraulically driven valve also provides a valve member positioned in the valve body that has a biasing hydraulic surface and a control hydraulic surface. Further, the hydraulic system includes a biasing pressure chamber defined at least in part by the valve body and the biasing hydraulic surface, and a control pressure chamber defined at least in part by the valve body and the control hydraulic surface. The biasing pressure chamber and the control pressure chamber are fluidly isolated from the first passage and the second passage. A medium pressure force acts on the biasing hydraulic surface. Also provided is a pilot valve having a first position in which the control pressure chamber is fluidly connected to the source of high pressure fluid, and a second position in which the control pressure chamber is fluidly connected to the low pressure fluid.

BEST MODE FOR CARRYING OUT THE INVENTION

Figure 1:
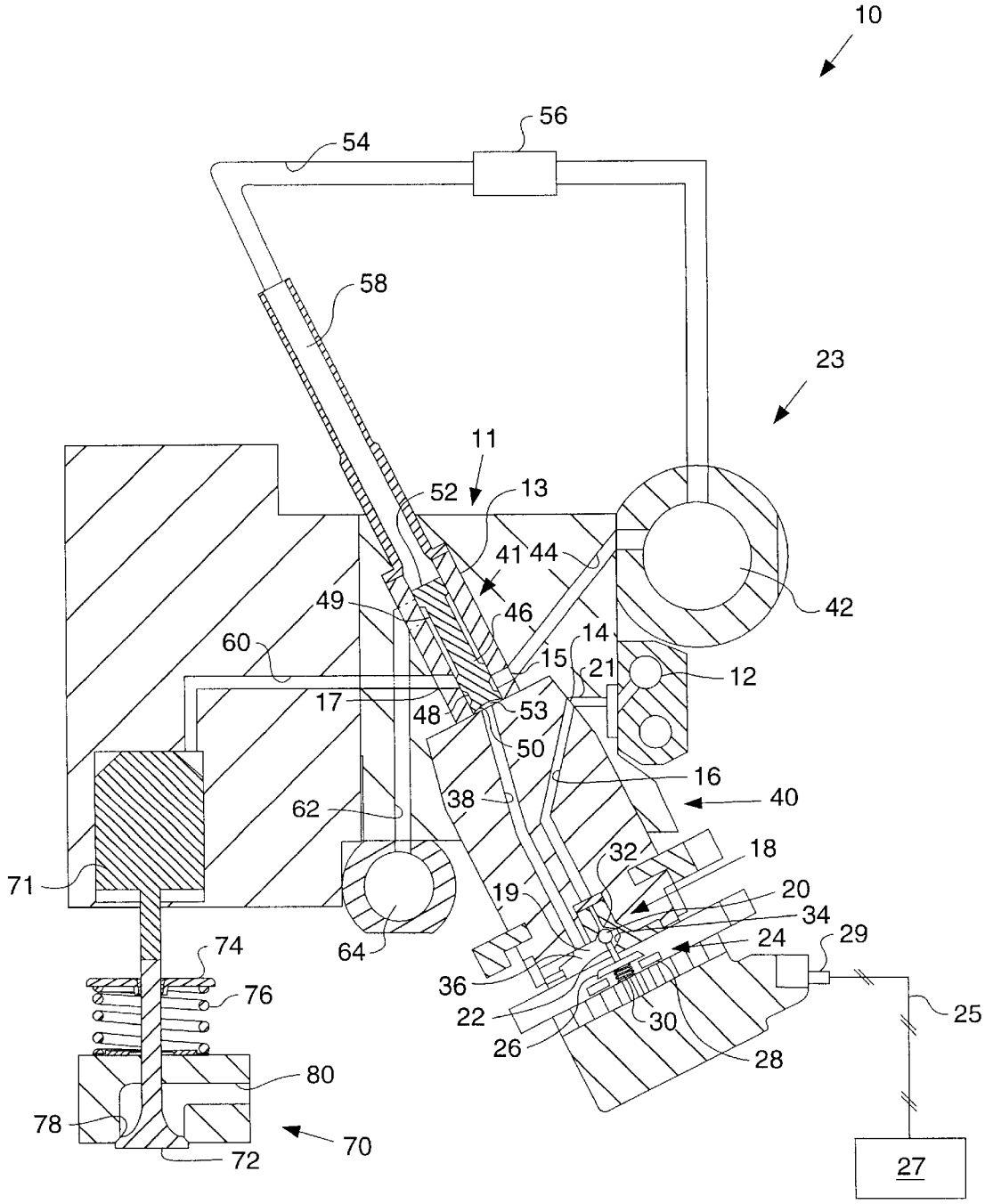
FIG. 1 is a partial diagrammatic side view of an engine including a hydraulically driven valve according to the preferred embodiment of the present invention.

Referring to FIG. 1, there is shown a partial sectioned side view of an engine 10 according to the preferred embodiment of the present invention. Engine 10 includes a plurality of cylinders that each include a hydraulic device 70 which has been illustrated as a gas exchange valve, and a control valve assembly 40. Control valve assembly 40 provides a spool valve 41 which controls the flow of actuation fluid to gas exchange valve 70, and a pilot control valve 18 which controls the movement of spool valve 41. Pilot control valve 18 is controlled in operation by an electrical actuator 24 which is preferably a solenoid but might be some other suitable device such as a piezoelectric actuator. Electrical actuator 24 is controlled with an electronic control module 27 in a conventional manner via a communication line 25 and electrical connector 29.

Gas exchange valve 70, which is preferably an exhaust brake, provides a hydraulic actuator 71 which can act on a gas exchange valve member 72. Valve member 72 is attached to a valve member extension 74. A biasing spring 76 exerts a biasing force on extension 74 which in turn biases valve member 72 against a gas exchange seat 78. In this position, valve member 72 closes a gas exchange passage 80. The state of gas exchange valve 70 is determined by alternately supplying either high pressure actuation fluid or low pressure fluid to hydraulic actuator 71. This supply of hydraulic fluid is controlled by a hydraulic system 23 provided by engine 10.

Hydraulic system 23 has a high pressure fluid source 42, a low pressure fluid source 64, and a hydraulically driven valve 11. Hydraulically driven valve 11 provides a valve body 13 which defines a first passage 44, a second passage 60, and a third passage 62. First passage 44 is fluidly connected to a source of high pressure actuation fluid 42 at one end, and to valve body 13 via a high pressure inlet 15 at the opposite end. Second passage 60 is fluidly connected to valve body 13 via a high pressure outlet 17 at one end, and to a hydraulic device 70 at its opposite end. Third passage 62 fluidly connects to valve body 13 at one end and to a low pressure reservoir 64 at its other end. Hydraulically driven valve 11 also provides a spool valve member 46 which is movably positioned within valve body 13. Spool valve member 46 is movable between a first position in which the first passage 44 is open to the second passage 60, and a second position in which the first passage 44 is closed to second passage 60. In spool valve member 46's first position, third passage 62 is blocked to fluid communication with either first passage 44 or second passage 60. In spool valve member 46's second position, second passage 60 is open to third passage 62.

Located on one end of spool valve member 46 is a control hydraulic surface 50. Defined in part by valve body 13 and by control hydraulic surface 50 is a control pressure chamber 53, which is fluidly connected to a pressure control passage 38 defined by valve body 13, and fluidly isolated from first passage 44, second passage 60, and third passage 62. Located on the opposite end of spool valve member 46 is a biasing hydraulic surface 52. A biasing pressure chamber 58 is defined in part by valve body 13 and by biasing hydraulic surface 52, and is fluidly isolated from first passage 44, second passage 60, and third passage 62. In the preferred embodiment, first passage 44, second passage 60, biasing pressure chamber 58, and control pressure chamber 53 all contain an identical fluid.

A medium pressure line 54 fluidly connects biasing pressure chamber 58 to high pressure fluid source 42. In the preferred embodiment, a pressure reducing valve 56 is preferably located within medium pressure line 54 which is capable of reducing the biasing fluid pressure from high pressure source 42 by approximately one half, thus providing a relatively constant medium hydraulic pressure to biasing pressure chamber 58 and biasing hydraulic surface 52.

Hydraulically driven valve 11 also provides a pilot valve 18 which is movable between a first (down) position and a second (up) position. Pilot valve 18 includes a ball 20 and pin 22. In the preferred embodiment, pilot valve 18 is controlled in operation by an electrical actuator 24 which is illustrated as a solenoid, but might be some other suitable device such as a piezoelectric actuator. Electrical actuator 24 consists of a coil 28 and an armature 26 which is operably coupled to pin 22. When electrical actuator 24 is de-energized, a biasing spring 30 biases armature 26 and hence pin 22 and ball 20 toward its second/up position. In this position, ball 20 closes a high pressure seat 32 and blocks high pressure passage 16, which is defined by valve body 13. High pressure passage 16 is fluidly connected to a second high pressure fluid source 12 via a high pressure inlet 14 and high pressure supply line 21. In the preferred embodiment, the high pressure fluid sources are shown as separate rails. This keeps pressure waves and fluctuations in one rail from affecting performance of hydraulic components connected to the other rail.

Valve body 13 also defines a control pressure cavity 19 which is positioned between high pressure seat 32 and a low pressure seat 34. High pressure passage 16 opens to cavity 19 via high pressure seat 32, and pressure control passage 38 opens to cavity 19 between high pressure seat 32 and low pressure seat 34. A low pressure drain 36, also defined by valve body 13 connects below low pressure seat 34.

When electrical actuator 24 is energized, armature 26 moves pin 22 out of contact with ball 20. Pin 22 then ceases to hold ball 20 against high pressure seat 32. The high pressure fluid in passage 16 can move ball 20 away from high pressure seat 32 to close low pressure seat 34. When ball 20 closes low pressure seat 34, low pressure drain 36 is blocked from fluid communication with cavity 19, and high pressure passage 16 is fluidly connected to pressure control passage 38 via cavity 19. As a result, high pressure is supplied to control pressure chamber 53 from pressure control passage 38. Recall that a constant medium pressure hydraulic force in biasing chamber 58 is acting on hydraulic surface 52. Because the respective ends of spool valve member 46 preferably have substantially equal areas, the effective force on control hydraulic surface 50 is greater than the force acting on biasing hydraulic surface 52. This difference in hydraulic force can move spool valve member 46 to its first position. When spool valve member 46 is in its first position, a high pressure annulus 48 machined on spool valve member 46 provides fluid communication between first passage 44 and second passage 60. Because first passage 44 is fluidly connected to high pressure fluid source 42, an annulus 48 can supply high pressure fluid to second passage 60 via high pressure fluid outlet 17.

High pressure fluid is thus supplied to gas exchange valve 70 from second passage 60. The high pressure fluid from passage 60 can act on gas exchange valve actuator 71, causing it to move gas exchange valve member 72 down. When valve member 72 moves downward, it lifts away from gas exchange seat 78, opening gas exchange passage 80. Gas exchange passage 80 is thus opened to allow for gas intake or exhaust depending on the desired application. The hydraulic force provided by gas exchange valve actuator 71 should be sufficient to overcome the force of biasing spring 76 which acts against gas exchange valve member extension 74 to bias valve member 71 toward its upward/closed position.

When electrical actuator 24 is de-energized, biasing spring 30 biases armature 26, and hence pin 22, against ball 20 to close high pressure seat 32. The strength of biasing spring 30 should be great enough to maintain ball 20 in a position closing high pressure seat 32 in spite of the fluid pressure in high pressure passage 16. When ball 20 is in this position, high pressure passage 16 is closed to fluid communication with cavity 19 and low pressure drain 36 is fluidly connected to pressure control passage 38. Because pin 22 extends into cavity 19 through the center of low pressure seat 34, its diameter should be such that adequate pressure release can take place around pin 22 and out low pressure drain 36 when ball 20 is closing high pressure seat 32. When high pressure seat 32 is closed, low pressure prevails in control pressure chamber 53 and medium hydraulic pressure in chamber 58 can act on biasing hydraulic surface 52 to hold spool valve member 46 in a second position in which first passage 44 is closed to fluid communication with second passage 60. In the preferred embodiment, the effective hydraulic areas of biasing hydraulic surface 52 and control hydraulic surface 50 are substantially equal. In spool valve member 46's second position, a low pressure annulus 49 machined on spool valve member 46 provides fluid communication between second passage 60 and a low pressure fluid reservoir 64 via third passage 62. Gas exchange valve actuator 71 is thus exposed to low pressure via second passage 60. With low pressure thus supplied to valve actuator 71, the force of biasing spring 76 can act on extension 74 to push valve member 72 toward its closed position to evacuate the used fluid and drain it for recirculation. In this position, valve member 72 holds gas exchange passage 78 shut, stopping gas exchange through passage 80.

Figure 2:
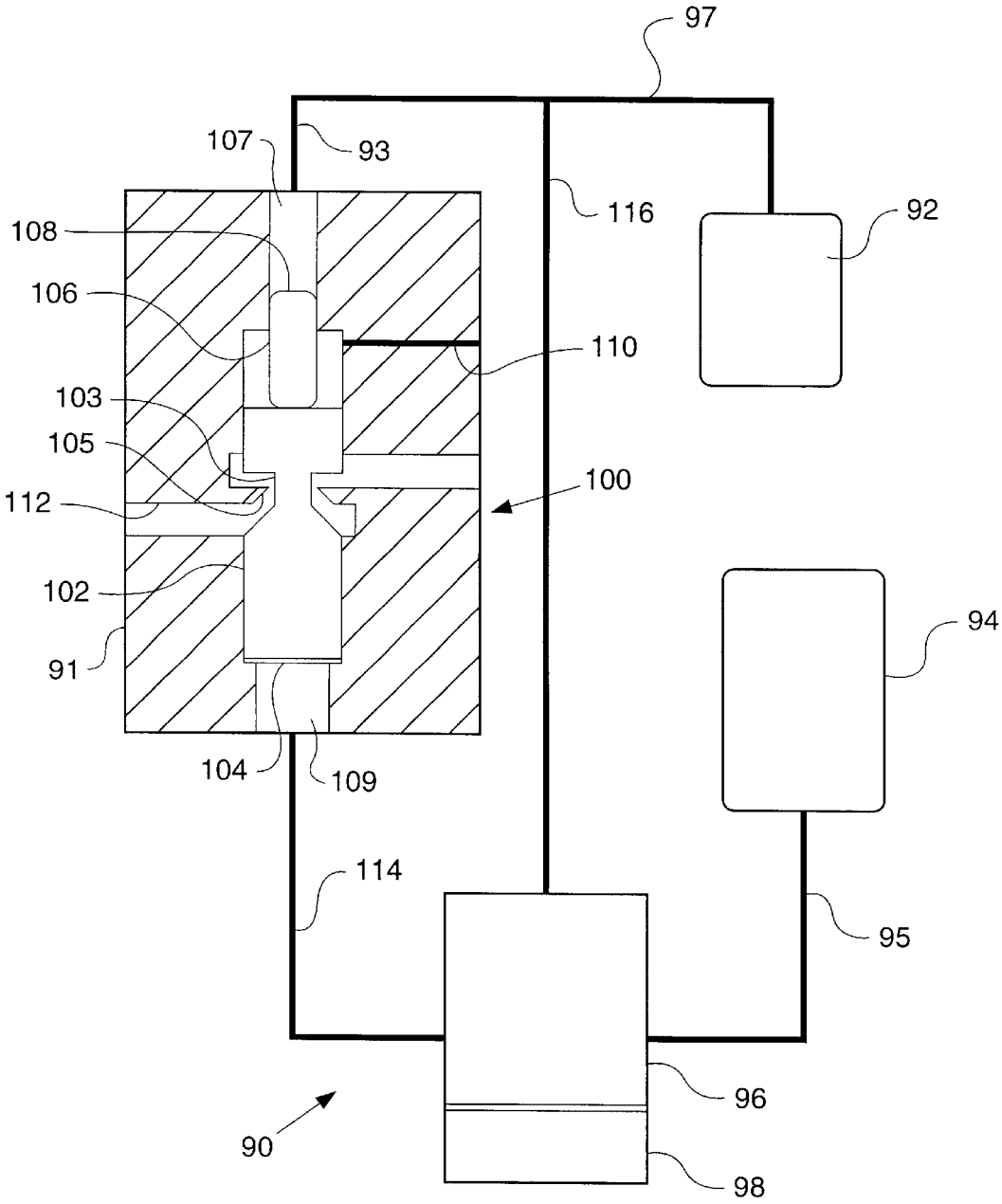
FIG. 2 is a diagrammatic representation of a hydraulic system and hydraulically driven valve according to a second embodiment of the present invention.

Referring to FIG. 2, there is shown a diagrammatic representation of a second embodiment of a hydraulic system 90 and hydraulically driven valve 100 according to the present invention. This embodiment does not provide a hydraulic device though it should be appreciated that a variety of hydraulic devices could be attached to, and benefit from this embodiment. In contrast to the preferred embodiment of the present invention, the hydraulically driven valve 100 in the second embodiment is shown as a poppet valve rather than a spool valve. Rather than a three-way valve, the second embodiment utilizes a two-way valve. The biasing means also differs from the preferred embodiment in that full system pressure rather than medium hydraulic pressure is employed.

Hydraulic system 90 provides a high pressure rail supply 92, a low pressure reservoir 94, the hydraulically driven valve 100, and a pilot valve 96. Poppet valve 100 provides a valve member 102 positioned within valve body 91 and movable between a first position and a second position. Valve member 102 is illustrated in its first position in which it fluidly connects a first passage 110 and a second passage 112, both defined by a valve body 91. When valve member 102 is in its second position, it closes a high pressure seat 105, blocking fluid communication between first passage 110 and second passage 112. On one end, valve member 102 has a control hydraulic surface 104 exposed to either high or low pressure in a control pressure chamber 109 defined in part by valve body 91 and by hydraulic surface 104. A pin 106 is also provided and is positioned in contact with valve member 102 at its opposite end. Pin 106 includes a hydraulic surface 108 exposed to full system pressure in a biasing pressure chamber 107. Biasing pressure chamber 107 is defined in part by valve body 91 and biasing hydraulic surface 108. The first branch 93 of high pressure supply line 97 provides constant high pressure fluid to biasing pressure chamber 107. The high pressure acting on hydraulic surface 108 of pin 106 biases pin 106 and consequently valve member 102 toward its first position. An annulus 103 machined on valve member 102 provides fluid communication between first passage 110 and second passage 112. In contrast to the preferred embodiment, a third passage is not provided.

Valve body 91 also defines a high pressure supply line 97 with a first branch 93 and a second branch 116, connected to the source of high pressure fluid 92, and a pressure control line 114. Valve assembly 100 is controlled in operation by a pilot valve 96, itself controlled by an electrical actuator 98, which is preferably a solenoid but might be some other suitable device such as a piezoelectric actuator. Pilot valve 96 is fluidly connected to the high pressure supply 92 by a second branch of the high pressure supply line 116, and to valve body 91 by pressure control line 114. Pilot valve 96 also fluidly connects to a low pressure reservoir 94 by a low pressure line 95.

When electrical actuator 98 is de-energized, pilot valve 96 provides fluid communication between pressure control passage 114 and low pressure drain 94 via low pressure line 95. Control pressure chamber 109 is thus exposed to low pressure, and the high pressure acting on hydraulic surface 108 of pin 106 biases valve member 102 toward its first position. When electrical actuator 98 is energized, pilot valve 96 provides fluid communication between the second branch 116 of high pressure line 97 and pressure control line 114. High pressure fluid is supplied via pressure control line 114 to control pressure chamber 109. High pressure in control pressure chamber 109 can act on control hydraulic surface 104 to force valve member 102 toward its second position where it closes high pressure seat 105. Because control pressure chamber 109 and biasing pressure chamber 107 are preferably both supplied with high pressure fluid, the fluid pressure inside the chambers is preferably substantially the same. In order that valve member 102 can be moved to its second position by the hydraulic pressure in control pressure chamber 109, the area of control hydraulic surface 104 should be larger than the area of pin hydraulic surface 108.

INDUSTRIAL APPLICABILITY

Referring to FIG. 1, the various components of valve 11 are shown in their positions just prior to the initiation of a gas exchange event. Solenoid 24 is de-energized, biasing spring 30 biases armature 26 and hence pin 22 against ball 20 to close high pressure seat 32. The control hydraulic surface 50 of spool valve member 46 is exposed to low pressure in control pressure chamber 53. Medium hydraulic pressure in biasing pressure chamber 58 acts on biasing hydraulic surface 52 of spool valve member 46 to bias it toward its second position, blocking fluid communication between first passage 44 and second passage 60, and providing fluid communication between second passage 60 and third passage 62, which is fluidly connected to a low pressure drain 64. Thus, gas exchange valve actuator 71 is exposed to low pressure in passage 60 and the force of biasing spring 76 on extension 74 holds gas exchange valve 70 closed.

When a gas exchange event is desired, solenoid 24 is energized and armature 26 moves pin 22 away from ball 20. When pin 22 ceases to exert force on ball 20 to close high pressure seat 32, the high pressure fluid in high pressure passage 16 pushes ball 20 away from high pressure seat 32 and toward low pressure seat 34. When ball 20 opens high pressure seat 32, fluid communication is established between high pressure passage 16 and pressure control passage 38 via cavity 19. Almost simultaneously, ball 20 closes high pressure seat 34 and blocks fluid communication with low pressure drain 36. High pressure fluid is now supplied from pressure control passage 38 and the pressure in control pressure chamber 53 rises dramatically. Because the effective hydraulic force on control hydraulic surface 50 is substantially greater than the force on biasing hydraulic surface 52, spool valve member 46 begins to move to its first position. High pressure annulus 48 now fluidly connects first passage 44 and second passage 60. Simultaneously, low pressure annulus 49 ceases to provide fluid communication between second passage 60 and third passage 62. This supplies high pressure via passage 60 to gas exchange valve actuator 71. Actuator 71 moves gas exchange valve member 72 downward against the biasing force of biasing spring 76 on extension 74. Valve member 72 lifts away from gas exchange seat 78 to open gas exchange passage 80.

Shortly before the desired end of the gas exchange event, current to electrical actuator 24 is terminated. The force from biasing spring 30 acts on armature 26 to move pilot valve 18 back toward its down position. Armature 26 pushes pin 22 against ball 20 to open low pressure seat 34 and close high pressure seat 32. As ball 20 opens low pressure seat 34, fluid communication is reestablished between pressure control passage 38 and low pressure drain 36 via cavity 19. Fluid communication is blocked between high pressure passage 16 and pressure control passage 38 when ball 20 closes high pressure seat 32. This results in a dramatic pressure drop in control pressure chamber 53. The medium hydraulic pressure from biasing pressure chamber 58 acting on hydraulic surface 52 is now sufficient to move spool valve member 46 back to its second position. As spool valve member 46 moves to its second position, high pressure annulus 48 ceases to provide fluid communication between passage 44 and passage 60, and low pressure annulus 49 once again provides fluid communication between passage 60 and low pressure drain 64 via third passage 62. Gas exchange valve actuator 71 is thus exposed to low pressure in passage 60. The force of biasing spring 76 on extension 74 of valve member 72 acts to move valve member 72 to close gas exchange seat 78, closing gas exchange passage 80.

Referring to FIG. 2, there is shown a second embodiment of the present invention with the valve member 102 in its first position. Electrical actuator 98 is de-energized, and pilot valve 96 exposes pressure control line 114 to low pressure through low pressure line 95 and low pressure drain 94. Control hydraulic surface 104 is thus exposed to low pressure in control pressure chamber 109. High pressure in biasing pressure chamber 107 can act on the hydraulic surface 108 of pin 106 to bias pin 106 and therefore valve member 102 toward its first position. Fluid communication is thus provided between first passage 110 and second passage 112.

When an injection event is desired, current to electrical actuator 98 is initiated. Pilot valve 96 opens pressure control line 114 to high pressure fluid from second branch passage 116 and blocks pressure control line 114 to fluid communication with low pressure line 95. High pressure in control pressure chamber 109 can then act on control hydraulic surface 104 to move valve member 102 to its second position, closing high pressure seat 105. First passage 110 is then blocked to fluid communication with second passage 112.

Shortly before first passage 110 and second passage 112 have been fluidly isolated for the desired length of time, current to electrical actuator 98 is terminated. Pilot valve 96 then moves to fluidly connect pressure control line 114 and low pressure line 95 while blocking fluid communication between second branch high pressure line 116 and pressure control line 114. The hydraulic pressure in control pressure chamber 109 drops dramatically, and the biasing force on biasing hydraulic surface 108 of pin 106 in biasing chamber 107 can act on pin 106 to move valve member 102 to its first position.

Referring once more to FIG. 1, it should be appreciated that a relatively large amount of fluid transfer is necessary to actuate the gas exchange valve. As a result, a relatively large quantity of fluid should pass through spool valve 40 in a relatively short time. Fluid moving quickly over the surface features of spool valve member 46 can create dynamic flow forces around the spool. For example, fluid flowing between high pressure annulus 48 and the edge of first passage 44 or second passage 60 could result in one side of the spool experiencing a different fluid pressure than the other. A net hydraulic force can be created due to flow conditions causing valve member 46 to get hung-up unless a sufficient biasing force is provided to force it closed. This potential for dynamic flow forces makes it desirable to provide a relatively strong biasing force on spool valve member 46. This ensures that the valve can be closed quickly in spite of hydraulic forces which may give it a tendency to stay open, allowing greater control over the timing of valve opening or closing. The use of biasing springs to this end has been largely unsuccessful due to the difficulty in providing a sufficiently strong spring in the limited space provided by the valve body. Furthermore, the necessity of using springs has heretofore hindered the development of certain valve designs. The hydraulic bias employed in the present invention overcomes these problems by providing a sufficiently strong biasing force in a substantially smaller space than would be required for a biasing spring.

It should be appreciated that the present description is intended for illustrative purposes only and is not intended to limit the scope of the present invention in any way. For instance, the dual high pressure rail system in the present description might be substituted with a single high pressure rail. Additionally, a medium pressure rail supply might be substituted for the pressure reducing valve in the present description. Thus, those skilled in the art will appreciate that various modifications could be made to the disclosed embodiments without departing from the intended scope of the present invention. Other aspects and features of the present invention can be obtained from a study of the drawings, the disclosure, and the appended claims.

What is claimed is:

1. A hydraulically driven valve comprising:

a valve body defining a first passage and a second passage;

a valve member positioned in said valve body and being moveable between a first position in which said first passage is open to said second passage, and a second position in which said first passage is closed to said second passage, and said valve member including a biasing hydraulic surface and a control hydraulic surface;

a biasing pressure chamber defined at least in part by said valve body and said biasing hydraulic surface;

a control pressure chamber defined at least in part by said valve body and said control hydraulic surface;

said biasing pressure chamber and said control pressure chamber being fluidly isolated from said first passage and said second passage;

a medium pressure force on said biasing hydraulic surface; and one of a high pressure force and a low pressure force on said control hydraulic surface.

2. The hydraulically driven valve of claim 1 wherein said medium pressure force includes a source of medium pressure fluid fluidly connected to said biasing pressure chamber;

said high pressure force includes a source of high pressure fluid fluidly connected to said control pressure chamber; and said low pressure force includes a source of low pressure fluid fluidly connected to said control pressure chamber.

3. The hydraulically driven valve of claim 1 wherein said biasing hydraulic surface has a smaller effective area than said control hydraulic surface.

4. The hydraulically driven valve of claim 1 wherein said valve member includes a spool with two ends; and one of said two ends being said biasing hydraulic surface, and an other of said two ends being said control hydraulic surface.

5. The hydraulically driven valve of claim 4 wherein said biasing hydraulic surface and said control hydraulic surface having substantially equal effective areas.

6. The hydraulically driven valve of claim 1 including a pilot valve moveable between an up position in which said control pressure chamber is fluidly connected to a source of high pressure fluid, and a down position in which said control pressure chamber is fluidly connected to a source of low pressure fluid.

7. The hydraulically driven valve of claim 6 including an electrical actuator operably coupled to said pilot valve.

8. The hydraulically driven valve of claim 1 wherein said valve body defines a third passage;

said third passage being closed to said first passage when said valve member is in said first position, and said third passage being open to said first passage when said valve member is in said second position.

9. The hydraulically driven valve of claim 1 wherein said first passage, said second passage, said biasing pressure chamber and said control pressure chamber contain an identical fluid.

10. A method of operating a valve, comprising the steps of:

providing a hydraulically driven valve including a valve body defining a first passage and a second passage, and a valve member positioned in the valve body and including a biasing hydraulic surface and a control hydraulic surface;

fluidly isolating the biasing hydraulic surface and the control hydraulic surface from the first passage and the second passage;

hydraulically driving the valve member toward a first position that opens the first passage to the second passage; and hydraulically driving the valve member toward a second position that closes the first passage to the second passage.

11. The method of claim 10 wherein said hydraulically driving steps include the steps of applying a medium pressure force to said biasing hydraulic surface; and applying one of a high pressure force and a low pressure force to said control hydraulic surface.

12. The method of claim 11 wherein said step of applying a medium pressure force includes a step of exposing the biasing hydraulic surface to a fluid with a medium pressure; and said step of applying one of a high pressure force and a low pressure force includes a step of exposing the control hydraulic surface to one of a fluid with a high pressure and a fluid with a low pressure, respectively.

13. The method of claim 12 including a step of sizing and arranging the biasing hydraulic surface and the control hydraulic surface to have substantially equal effective areas.

14. The method of claim 13 including a step of locating the biasing hydraulic surface on one end of the valve member; and locating the control hydraulic surface at an opposite end of the valve member.

15. The method of claim 14 wherein said step of exposing the control hydraulic surface includes a step of moving a pilot valve from a first position to a second position with an electrical actuator.

16. A hydraulic system comprising:

a source of high pressure fluid;

a source of low pressure fluid;

at least one hydraulic device;

a hydraulically driven valve including a valve body defining a first passage and a second passage, and a valve member positioned in the valve body and including a biasing hydraulic surface and a control hydraulic surface;

a biasing pressure chamber defined at least in part by said valve body and said biasing hydraulic surface;

a control pressure chamber defined at least in part by said valve body and said control hydraulic surface;

said biasing pressure chamber and said control pressure chamber being fluidly isolated from said first passage and said second passage;

a medium pressure force on said biasing hydraulic surface; and a pilot valve having a first position in which said control pressure chamber is fluidly connected to said source of high pressure fluid, and a second position in which said control pressure chamber is fluidly connected to said source of low pressure fluid.

17. The hydraulic system of claim 16 wherein said medium pressure force includes a source of medium pressure fluid fluidly connected to said biasing hydraulic surface.

18. The hydraulic system of claim 17 wherein said at least one hydraulic device includes a gas exchange valve actuator.

19. The hydraulic system of claim 18 wherein said valve member is a spool valve member with two ends; and one of said two ends being said biasing hydraulic surface, and the other of said two ends being said control hydraulic surface.

20. The hydraulic system of claim 19 wherein said first passage, said second passage, said biasing pressure chamber and said control pressure chamber contain an identical fluid.

* * * * *